US005183262A

United States Patent [19]

Heddon

[11] Patent Number: 5,183,262

[45] Date of Patent: Feb. 2, 1993

[54] BOWLING LANE AND REFINISHING METHOD

[76] Inventor: Will Heddon, 1422 Chamberlain Loop, Lake Wales, Fla. 33853

[21] Appl. No.: 681,052

[22] Filed: Apr. 5, 1991

[51] Int. Cl.[5] ..... A63D 1/00

[52] U.S. Cl. ..... 273/51

[58] Field of Search ..... 273/51

[56] References Cited

U.S. PATENT DOCUMENTS

| | | | |
|---|---|---|---|
| 2,531,168 | 11/1950 | Snyder | 273/51 |
| 3,014,722 | 12/1961 | Green | 273/51 |
| 3,670,049 | 6/1972 | Stein et al. | 273/51 X |
| 4,205,842 | 6/1980 | Murrey, Sr. | 273/51 |
| 4,205,843 | 6/1980 | Murrey, Sr. | 273/51 |
| 4,244,570 | 1/1981 | Murrey, Sr. | 273/51 |
| 4,795,152 | 1/1989 | Suiter | 273/51 |
| 4,867,816 | 9/1989 | Suiter | 273/51 X |
| 4,944,514 | 7/1990 | Suiter | 273/51 |

*Primary Examiner*—William H. Grieb

*Attorney, Agent, or Firm*—Allen, Dyer, Doppelt, Franjola & Milbrath

[57] ABSTRACT

A bowling lane and method for constructing the same. The bowling lane includes a plurality of synthetic panels having a tab and a notch cut formed along the side surface. The synthetic panels are attached to a bowling lane substructure with screws. Flat dowels are placed over the screws to provide a smooth bowling lane surface. Panels are juxtaposed so that the tab of one panel fits into the notch of its adjacent panel. One side of a plastic film is attached to the juxtaposed panels with a contact adhesive. A hardened finishing coat is applied to the other side of the film to provide a sliding surface. The film functions as a barrier layer between the finishing coat and the panels' top surface so that the bowling lane may be refinished by peeling the film from the lane. The film also attaches to the dowels and the lane to prevent the dowels from popping up when the bowling ball rolls down the lane. A foul line coupling is provided to connect a wood approach panel to a synthetic bowling lane.

13 Claims, 2 Drawing Sheets

BOWLING LANE AND REFINISHING METHOD

BACKGROUND OF THE INVENTION

The present invention relates to finishing a floor surface and method for constructing the same. More particularly, the invention relates to constructing a bowling lane in a manner that allows more precise construction while providing a lane surface that is both resistant to wear and easy to maintain.

There are several types of synthetic lanes on the market today. Most of these lanes have evolved from techniques developed by General Electric Company. These techniques include a 1⅛-inch thick phenolic impregnated plastic laminate having a decorative panel shaped thereon. The surface of the phenolic appears as a wooden bowling lane. The technique uses a laminated panel that is attached with contact cement to the surface of the old lane and becomes the bowling surface. The panels include four bowling lane areas: an approach area, a sliding area, a lane area and a pin deck area.

A main drawback to this technique was that the phenolic decorated laminate sheet did not stick properly to the old wood lane. In addition, the wood lane would tend to move causing the laminate that was put on top to crack.

In dealing with this problem, it is known to attach a thick phenolic sheet with screws in the ball drop area of the lane within about the first four to five feet of the approach area. Laminate is then placed on top of the phenolic panel. A particle board is placed on the balance of the lane having the same thickness as the phenolic panel. This particle board is also screwed down like the phenolic sheet. A printed plastic sheet is placed on the top of a ⅜-inch phenolic panel. The panel is placed on the top surface of the old lane. The phenolic sheets are placed together so that they abut each other resulting in a seam or joint. The plastic panels are then screwed to the existing bowling lane surface. This technique eliminates the need for thick phenolic as support panels. The phenolic panel itself has print on its top surface indicating arrows and pin placement.

A drawback for this technique is that it is very expensive as it requires additional manufacturing steps. Another drawback to this technique is that where plastic panels are put together and when oil is placed on the lane, the oil may seep down in between the panels and contaminate the particle board to make the joints swell. Moisture has also been found to seep into the joint and contact the particle board. Consequently, the lanes may swell to exceed acceptable American Bowling Congress tolerances.

A further problem with this technique is that a seam is present adjacent the location where the panel in the approach area contacts the panel in the slide area. It is desirable to remove the seam so that the bowler does not slide on it when the bowler steps on the approach panel near the seam. This seam may pop out as the bowling ball rolls along the side of the lane, especially when the panel in the approach portion of the lane is tight up against the sheets in the slide portion of the lane. Consequently, a jacking effect may be created where one surface of the approach panel actually jacks up onto a lane panel, resulting in the edges along the seam of the panels being uneven. If one panel becomes higher than the other, a hazard may result where the bowler could trip or the bowler's slide may be interrupted.

Other techniques that have been used for manufacturing bowling lanes are disclosed in Murrey's U.S. Pat. Nos. 4,205,843, 4,205,842 and 4,244,570. These patents disclose using synthetic lanes that have a separate pin deck. The portion of the lane that is underneath the machine that sets the bowling pins is a separate panel and it is normally constructed with a composite of different structures. The systems disclosed in the Murrey patents use a barrier plate that is strong enough to withstand impact of the pins and does not need a separate pin deck.

A drawback of the Murrey system is that it requires decorative laminate panels that are put on top of a very expensive aluminum barrier plate. Decorative laminate is expensive and necessary to prevent scratching and abrasion of the lane. Current techniques for constructing a lane are designed such that the slide area and the pin deck area become a permanent part of the bowling lane.

Another drawback to the aforementioned techniques is that when a solid phenolic is used as a lane surface, that portion of the lane that uses the phenolic is not totally free from warpage. This warpage is due to moisture and other different characteristics of the materials that result in bending or twisting at the panels' joints. Again, these problems may become so severe that the joints exceed the tolerances of the American Bowling Congress over the entire surface of the lane. This problem is further compounded when panels having different materials are abutted against each other.

Many of the existing bowling lanes are constructed with 48-inch wood paneling in the approach area and 42-inch wood paneling in the lane area. A foul line extends across the lane to separate the approach area from the lane area. One such foul line includes a flat fiber material that extends along the surface of the lane straight down. This foul line is typically glued or fastened onto the side surface of the lane area and the approach area.

When a bowling ball is successively dropped on the lane adjacent the foul line, a small groove may form in the lane. Over time this groove becomes larger requiring that the lane be repaired or replaced. Further, the location of the wood panels abutting the foul line may tend to shimmy, also necessitating repair of the lane.

Synthetic lanes such as phenolic tend to be less susceptible to shimmying, however, synthetic lanes may be more expensive than natural wood. Further, current techniques for replacing old wood lanes with synthetic lanes require that the old approach area be replaced. When the player bowls on a synthetic approach panel, the feel to the player as a result of sliding on a synthetic panel may be different from the feel to the players than sliding on a wood approach panel. The feel of sliding on the wood approach panel is preferred.

When a synthetic lane is constructed, it is attached to a subsurface using screws. Once attached, a removable synthetic flat top dowel is placed snugly in a circular aperture that partially extends into the surface of the lane panel over the top of the screw to provide a smooth bowling surface. However, due to excessive vibrations that can occur when a bowling ball hits the lane, the dowels have a tendency to pop-up. This lane must be periodically serviced to push the dowels back in place.

SUMMARY OF THE INVENTION

An objective of this invention is to provide an improved bowling lane and method for constructing the same.

Another objective of this invention is to design a new lane that eliminates the pin deck portion as a separate entity and have the pin deck portion become part of the entire bowling lane system.

It is also an objective of this invention to design a lane that forms a solid panel with film and finish on the lane's surface that is unable to expand and contract to a point where a phenolic base layer is affected.

It is an additional objective of the invention to construct a bowling lane that has no special approach panel or melamine surfaces.

It is a further objective of this invention to construct the bowling lane using standard off-the-shelf phenolic panels that are cut to size to provide protection from scarring on the melamine.

An additional objective of this invention is to place film on the phenolic surface that acts as a base for a finished coat placed thereon.

A further objective of the invention is to place a coat of film on the bowlable surface with an adhesive permitting the film to be removed at a later time without damaging the melamine or lane surface below it.

It is also an objective of the invention to use a step joint when placing panels on the lane so that adjacent panels may not slide up and down to create a joint or a seam.

Another objective is to couple joints of adjacent panels together so that a smooth joint is maintained, and to place a film over the joint to prevent moisture or contaminants from seeping into the joints to maintain the lane within acceptable tolerances.

A further objective of the invention is to place panels on a lane having a lap or step joint contacting adjacent panels so that said panels move together to prevent the lane from exceeding the American Bowling Congress tolerances.

An objective of the invention is to provide a bowling lane that has the feel to the player of sliding on wood while having the lane maintainable feature of synthetic material.

Another objective of the invention is to construct a lane with a wood strip that prevents shimmy at adjacent panels after extensive bowling lane use.

An additional objective of this invention is to construct a lane having a foul line coupling that attaches the approach panel to the lane panel while positioning a film over the lane panel that is prevented from stretching or cracking due to lane shimmy or bowling ball vibrations.

A further objective of the invention is to prevent the dowels used in lane construction from popping up after extensive bowling lane use.

These and other objectives are accomplished by a method of constructing a bowling lane joint comprising the steps of providing a first elongated panel having a top surface, a bottom surface and an edge extending in a straight line from one side of the panel to the other. A notch is then formed in the first panel along one of the surfaces adjacent the edge, so that the edge forms a tab between the top and bottom surface. A second elongated panel is provided having a top surface, a bottom surface and an edge extending in a substantially straight line from one side of the panel to the other. A notch is then formed in the second panel along one of the surfaces adjacent the edge, so that the edge forms a tab between the second panel's top and bottom surfaces. The panels are juxtaposed so that the tab of the first panel inserts into the notch of the second panel and the tab of the second panel inserts into the notch of the first panel to form a joint that prevents the lane from exceeding tolerances during use.

Alternately, a bowling lane is provided comprising a phenolic panel having a top surface, and a plastic film attached to the top surface with a layer of contact adhesive secured to one side of the film. A coat of finishing material is then applied to the other side of the film having an integrally hardened surface so that this lane finish material may be removed easily when refinishing.

According to another method of this invention, the above objectives may be accomplished with a method of refinishing a bowling lane comprising the steps of attaching a plastic film with contact adhesive secured to one side of the film to a top surface of a synthetic bowling lane. The other side of the film is then coated with a liquid finish that cures to form a hardened surface on the plastic film surface. It is preferable that the hardened surface may be removed from the lane by peeling the plastic film off the top surface of the lane to provide a barrier layer for the top surface. Thus the hardened surface may easily be removed without damaging the lane's surface below it. .

Another technique within the scope of this invention is to provide a bowling lane for supporting bowling balls. The bowling lane comprises a bowling lane substructure, a synthetic bowling lane panel with a flat top surface, and a plurality of apertures penetrating partially into the top surface. A plurality of screws are disposed within the aperture and attach the lane to the substructure. The dowel is inserted into the aperture over said screws. The dowel maintains a friction fit against the sides of the aperture, and has a flat top surface substantially in alignment with the bowling panel flat top surface. The bowling lane also includes means attached to the top surface of the dowel and the panel for preventing the dowels from popping up when the bowling balls roll down the lane.

In another embodiment a method for constructing a bowling lane is provided comprising the steps of: providing an approach panel having a flat top surface with a step formed along one side of the approach panel's sides. A J-shaped foul line coupling having a flat top surface open portion is provided. A lane panel having a flat top surface with a step formed along one side of the lane panel's sides is also provided. A J-shaped coupling abuts against the side of the approach panel within the step so as to form a continuous flat top surface with the top surface of the approach panel and the top surface of the J-shaped couplings. The step of the lane panel is inserted into the open portion of the J-shaped coupling to form a continuous flat top surface with the top surface of the J-shaped coupling and the top surface of the lane panel. The J-shaped coupling holds the approach panel in place while remaining fastened to the approach panel to prevent shimmying.

Another form of the technique within the scope of this invention is provided with a bowling lane comprising an approach panel having a flat top surface and a step formed into the panel along a first of the panel's sides. Abutting the approach panel is a coupling having a bottom portion, a riser portion and a top portion. The bottom portion rests on the step formed into the side panel. The riser portion in cross-section extends along the panel's first sides in an angle substantially perpendicular to the bottom portion. The coupling also has a top portion that extends away from the riser and said panel parallel to the bottom portion. The bowling lane also includes a lane portion having a flat top surface with a step formed into the lane panel along one of the lane panel's sides. The lane panel step is coupled to the coupling such that a continuous flat surface is formed along the top surface of the approach panel, the coupling and the lane panel. Accordingly, the approach panel in a bowling lane may be constructed from wood and the lane panel may be constructed from a synthetic material such as phenolic.

DESCRIPTION OF THE PREFERRED EMBODIMENT

Figure 1:
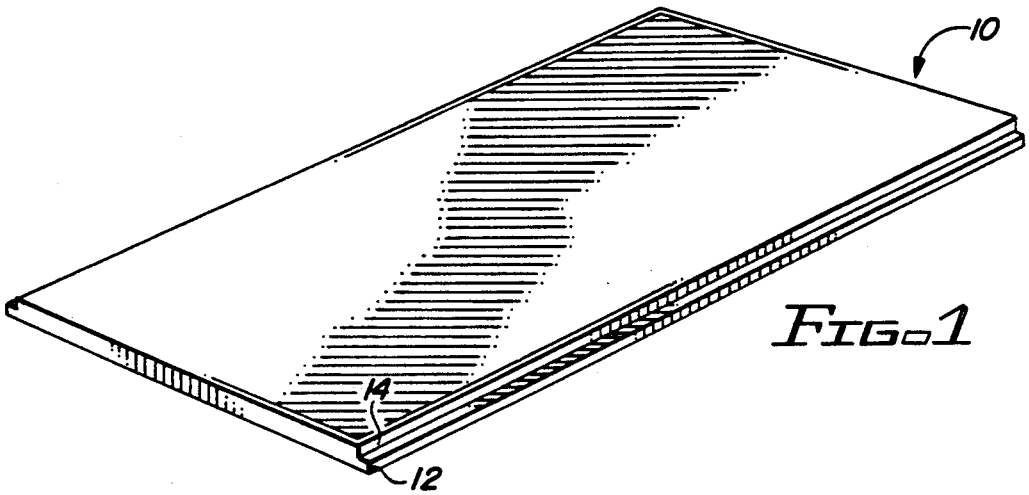
FIG. 1 is a perspective view of the approach panel used in constructing the bowling lane with a step joint along the panel's outer perimeter.

Referring to FIG. 1 there is shown an approach panel 10 that includes the approach area and the sliding area of the lane. The approach panel 10 is preferably forty-eight inches wide and eight feet long. The approach panel 10 is preferably constructed using a ¼ inch to ¾ inch phenolic core. The approach panel 10 includes a tab 12 that runs along three sides of the perimeter of approach panel 10. Cut out of approach panel 10 is notch 14 which extends adjacent tab 12 along the edge of approach panel 10. Notch 14 and 14' (FIG. 3) extends approximately halfway up the side of the panel. Tab 12 and notch 14 form a step joint 22 (FIG. 3) when coupled to adjacent approach panel 10 or adjacent lane panel 16 (FIG. 2 and FIG. 3).

Figure 2:
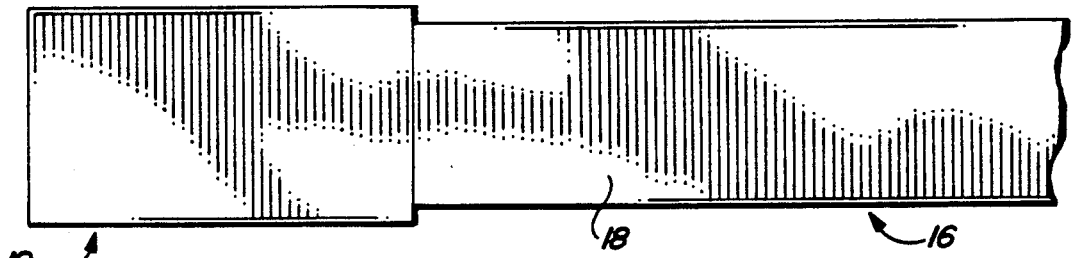
FIG. 2 is a top view of a portion of a bowling lane displaying an approach section and a portion of the lane section.
Figure 3:
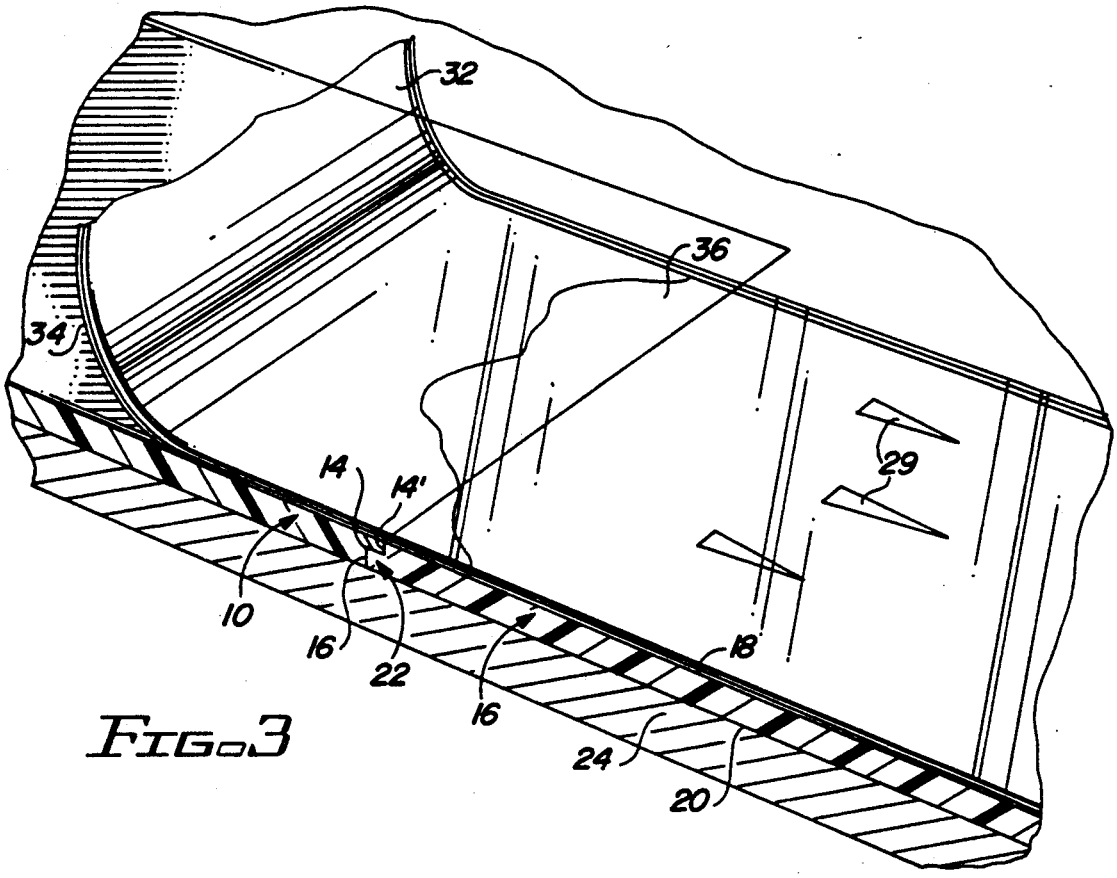
FIG. 3 is a side sectioned view of a bowling lane having a film coating and a lane finish.

Referring to FIG. 2 and FIG. 3, there is shown the approach panel 10 coupled to a elongated lane panel 16. This elongated lane panel 16 is preferably forty-two inches wide with an eight to twelve foot length with a ¼-inch to ¾-inch phenolic core. Elongated lane panel 16 is juxtaposed to approach panel 10.

Referring to FIG. 3, elongated lane panel 16 has a top surface 18 and bottom surface 20. Disposed at each end of lane panel 16 is a notch 14' and tab 12'. Notch 14' of elongated lane panel 16 mates with the tab 12 of approach panel 10 and tab 12' of adjacent lane panel 16. The tab 12' of elongated lane panel 16 mates with the notch 14 of approach panel 10 and adjacent lane panel 16 when lane panel 16 is juxtaposed to panel 10. Notches 14 and 14' and tabs 12 and 12' of adjacent panel 16 are juxtaposed to form step joint 2 to maintain joint separation within the American Bowling Congress tolerances.

Elongated lane panel 16 and approach panel 10 are coupled together through step joint 22. Lane panel 16 and approach panel 10 are mounted to a substructure 24 with screws (not shown). This substructure 24 may be any existing lane. Substructure 24 may not be required in constructing a new lane.

The bowling alley lane is constructed by attaching both the elongated lane panel 16 and the approach panel 10 onto substructure 24. Lane markings 28 are then applied to top surface 18 of elongated lane panel 16. The markings 28 are preferably attached to the lane using contact tape. However, other methods of constructing markings may also be used, including etching the marking 28 into the panel itself. Once markings 28 have been placed on top surface 18 a clear flexible plastic film barrier 32, having a contact adhesive 34, is applied to one side of the film barrier 32. The adhesive 34 is applied between the film barrier 32 and the approach panel 10 or lane panel 16. A preferable method of applying plastic film barrier 32 to panels 10 or 16, is similar to the method of applying plastic film to a floor as described in U.S. Pat. No. 4,795,152, U.S. Pat. No. 4,867,816 and U.S. Pat. No. 4,944,514, which are hereby incorporated by reference. The thickness of the plastic is also preferably the same thickness as the film described in the aforementioned patents Once plastic film barrier 32 has been extended over the lane panel 16 and approach panel 10, a lane finish material 36 may then be applied over film barrier 32. Examples of lane finishes include HONOR ROLL, manufactured by Polymetrics, Inc. of Maitland, Fla., and U300, manufactured by Perry-Austen of Des Moines, Iowa. Other lane finishes include a top coat of urethane with a slip agent such as silicon glyceride, or epoxies with good plastic film adhesive characteristics. The lane finish material 36 provides the proper resistance to bowling bowls when rolling over the lane. It is preferable that the lane finish that is used be applied as a liquid and then cured to form a integrally hardened finish.

Plastic film barrier 32 is thus used as an inner layer so as to allow the permanent hardened lane finish material 36 to be easily removed when refinishing the lane. Once the lane finish material 36 has been placed over plastic film barrier 32, the lane is ready for use. It is recognized that through time, this hardened lane finish will become scratched and scuffed up and thus will have to be replaced. This lane finish material 36 is easily removed by peeling up film barrier 32 from approach panel 10 and lane panel 16. Once film barrier 32 has been removed, the adhesive 34 may easily be cleaned from the phenolic with known adhesive-removing solvents. Once the lane has been cleaned, a new plastic film barrier 32 is placed on the lane and a new lane finish material 36 is coated over the film barrier 32. It is contemplated that the ease of which this lane finish material 36 is removed provides advantages in lane refinishing.

Figure 4:
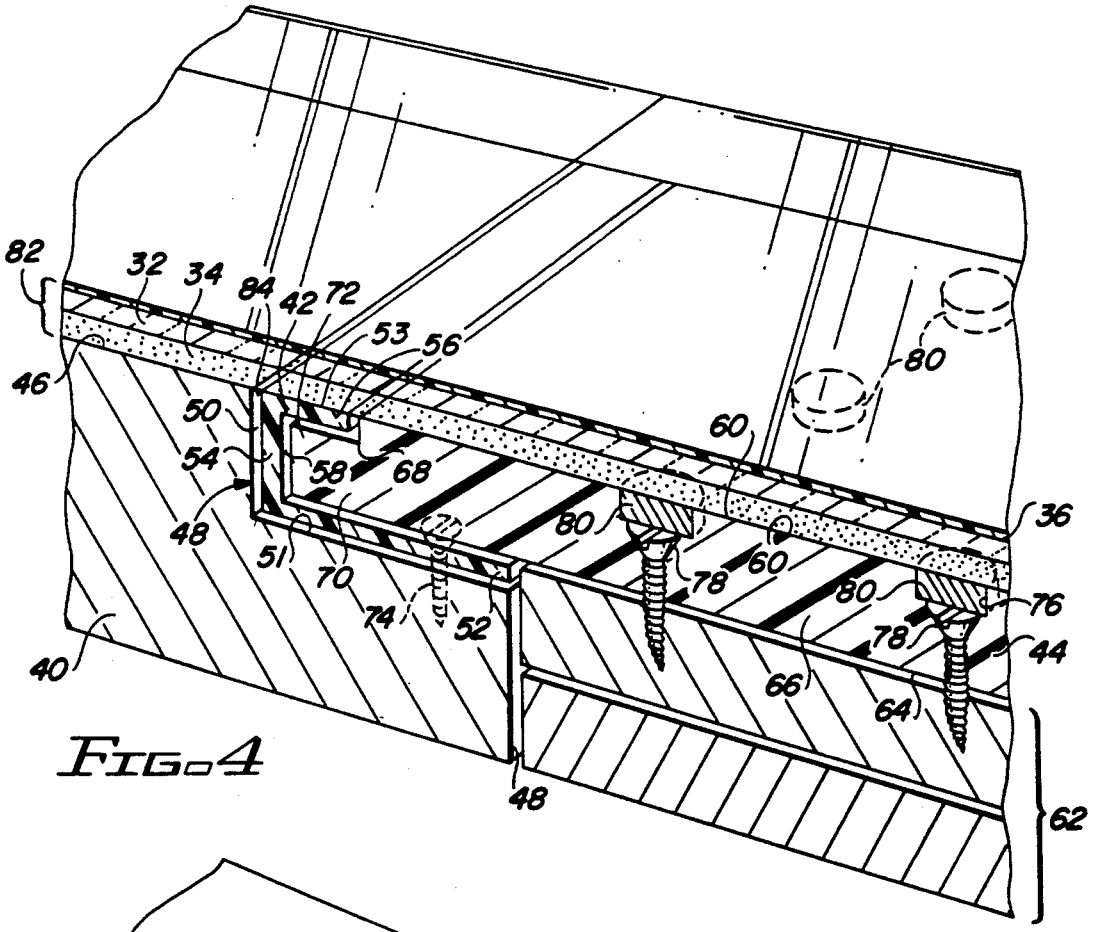
FIG. 4 is an alternate embodiment of the bowling lane shown in FIG. 3 showing a side sectioned view of a synthetic lane panel coupled with a foul line strip to a wood approach panel.

Referring to FIG. 4, there is shown a wood approach panel 40 coupled with a J-shaped foul line coupling 42 to a synthetic lane panel 44. Wood approach panel 40 has a flat top surface 46 and a front side 48. A notch 50 is cut out from a portion of approach panel 40 from the top of its front side 48 to form a step 51. Resting on this step 51 is J-shaped foul line coupling 42.

J-shaped foul line coupling 42 includes a flat bottom portion 52 integrally connected to a perpendicular riser portion 54. Riser portion 54 extends upwards from bottom portion 52 and terminates in a top portion 56. Top portion 56 has a flat top surface 53 that extends away from panel 40, extends perpendicular to riser portion 54 and parallel to bottom portion 52. Bottom portion 52 with riser portion 54 and top portion 56 partially enclose open portion 58. J-shaped foul line coupling 42 and bottom portion 52 rests on step 51. Flat top surface 53 is preferably coplanar with flat top surface 46.

It is preferable that J-shaped foul line coupling 42 be constructed from a vinyl, metal, composite, or other strong material so as to withstand the impact of a bowling ball contacting flat top surface 53. The preferable dimensions of J-shaped foul line coupling 42 are as follows: Bottom portion 52 is preferably 1½-inches long by ¼-inch high. The riser is preferably ¾-inch high extending from the bottom of bottom portion 52 to top surface 53 and ¼-inch wide. The preferable width of top portion 56 is ½-inch with a ¼-inch height. The length of coupling 42 preferable extends from one side of the bowling lane to the other side, which is typically 42 inches wide.

Abutting wood approach panel 40 is a bowling lane substructure 62. This substructure 62 is preferably constructed using one or more plywood planks that are screwed together using standard attachment techniques. Bowling lane substructure 62 has a flat top surface 64 which is coplanar with the top surface of bottom portion 52.

Resting on top surface of substructure 62 and bottom portion 52 is synthetic bowling lane panel 66. Lane panel 66 is preferably constructed from a phenolic using standard manufacturing techniques. Lane panel 66 has a top surface 60 and preferably has a notch 68 and tab 70 which are cut out of lane panel 44 to form a step 72 as previously described in connection with FIGS. 1 through 3. Step 72 is inserted into the open portion 58 of foul line coupling 42 so that lane panel 66 abuts on one side of riser portion 54 and the other side of riser portion 54 abuts wood approach panel 40. When step 72 is inserted into foul line coupling 72, it is preferable that the top surface 53 be coplanar with top surface 60.

J-shaped foul line coupling 42 is attached to wood approach panel 40 using a plurality of screws 74. Screws 74 are preferably evenly spaced six to twenty-four inches apart in bottom portion 52 from one side of the bowling lane to the other.

Bowling lane panel 44 includes a plurality of apertures 76 which extend into top surface 60 of lane panel 66 from one side to the other. Screws 78 are inserted through apertures to connect bowling lane panel 44 to bowling lane substructure 62. After screws 78 have been inserted through lane panel 66, dowels 80 are placed on top of screws 78. Dowels 80 are held in to bowling lane panel 44 with a friction fit. Dowels 80 have a flat top surface which is coplanar to the flat top surface 60.

Extending over top surface 60 and wood approach panel 40 is an elongated flexible sheet 82 which includes a clear plastic film barrier 32 and a contact adhesive 34. The plastic film barrier 32 is attached over the approach panel 40, foul line coupling 42, lane panel 44 and dowels 80 using the techniques described in connection with FIGS. 1 through 3. It is recognized that by placing a clear plastic film barrier 32 over the location where bowling lane panel 44, coupling 42 and approach panel 40 abut, moisture and contaminants are prevented from falling into groove 84. Thus, approach panel 40 is prevented from swelling, and shimmying between the panels is reduced.

It is also recognized that J-shaped foul line coupling 42 is ridged, thereby maintaining top surface of lane panel 44 coplanar to the top surface of wood approach panel 40. Accordingly, panels of different materials may be connected in the same bowling lane without shimmying.

Clear plastic film barrier 32 extends across dowel 80, aperture 76 and bowling lane 44. This clear film barrier 32 is held in place with a contact adhesive 34. Adhesive 34 and film barrier 32 serve a dual purpose when used on lane panel 44. First, film barrier 32 protects the bowling lane panel 44 from contaminants falling into aperture 76 and harming the lane. Second, film barrier 32 in combination with contact adhesive 34, holds dowels 80 in place during bowling by preventing these dowels from popping up due to the vibration of the bowling ball striking the bowling lane panel 44 and rolling down the bowling lane.

After the bowling lane has been constructed, one side of flexible sheet 82 is securely attached to approach panel 40 and lane panel 44. The other side of flexible sheet 82 is coated with lane finish material 36. The technique for coating this finish material 36 was described previously in connection with FIGS. 1 through 3.

Figure 5:
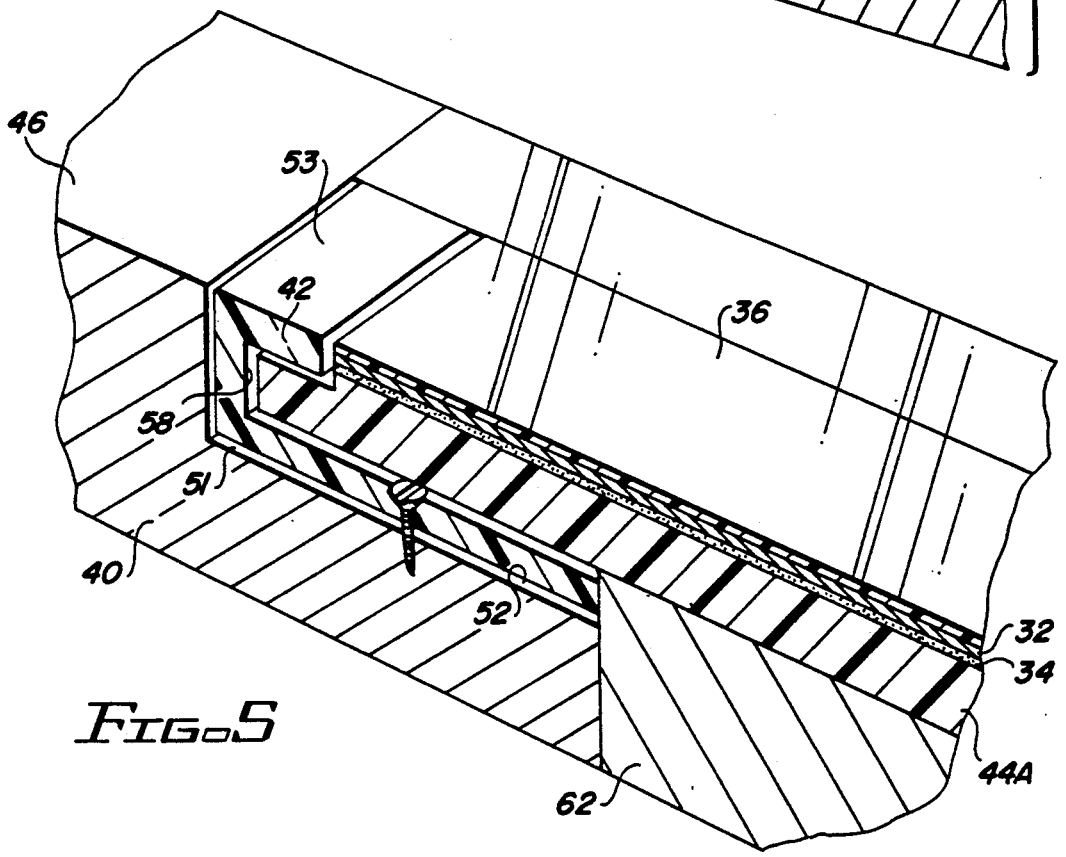
FIG. 5 is a side sectioned view of an alternate embodiment of the bowling lane shown in FIG. 4 with the synthetic lane panel having a top surface at a different level than the top surface of the foul line strip.

Referring to FIG. 5 there is shown an alternate embodiment of the bowling lane, in particular having synthetic lane panel 44 that is different than lane panel 44 shown in FIG. 4. In FIG. 5, approach panel 40 is coupled to synthetic lane panel 44*a* with foul line coupling 42 to form a contiguous bowling lane. Foul line coupling 42, as in FIG. 4, rests on step 51 carved out of approach panel 40. Approach panel 40 has a flat top surface 46 that aligns with a flat top surface 53 of foul line coupling 42. However, flat top surface 60 in FIG. 5 is not coplanar with the flat top surface of foul line coupling 42. The level of flat top surface 60 is below that of flat top surface 53 and forms a step-up junction with the top surface of coupling 42.

Synthetic lane panel 44*a* rests on a substructure 62 and foul line coupling 42 bottom portion 52. Synthetic lane panel 44*a* also forms a step at one end that is coupled to open portion 58 of foul line coupling 42. Plastic film barrier 32 is attached to flat top surface 60 with contact adhesive 34 using the methods previously described. It is recognized, that in this configuration, plastic film barrier 32 does not extend onto the flat top surface 53 of foul line coupling 42. By not extending film barrier 32 over flat top surface 53, plastic film barrier 32 is prevented from tearing when a bowling ball strikes synthetic lane panel 44*a* during use. It is preferable that a lane finish material 36 be applied over plastic film barrier 32. It is also preferable that the top surface of lane panel 44*a* with finish material 36 be coplanar with flat top surface 53 and flat top surface 46.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method of constructing a bowling lane comprising the steps of:

providing an approach panel having a flat top surface and a step formed along one of said approach panel's sides;

providing a generally J-shaped foul line coupling having a flat top surface and an open portion;

providing a lane panel having a flat top surface and a step formed along one side of said lane panel's sides;

abutting said J-shaped coupling against said side of said approach panel within said step so that said foul line coupling's flat top surface and said approach panel's top surface are coplanar; and inserting the step of said lane panel into the open portion of the J-shaped coupling.

2. The method of constructing a bowling lane panel as recited in claim 1 wherein the top surface of the J-shaped coupling and the top surface of the lane panel are coplanar when the step of the lane panel is inserted into the open portion of the J-shaped coupling.

3. The method of constructing a bowling lane as recited in claim 1 further comprising the step of attaching the J-shaped coupling to a top surface of the step formed along the approach panel side.

4. The method of constructing a bowling lane as recited in claim 1 further comprising the steps of attaching a layer of clear flexible plastic with adhesive disposed on one side of said plastic on the top surface of approach panel, said lane panel, and said J-shaped coupling to prevent particles from migrating into any crack between said J-shaped coupling and either said approach panel or said lane panel.

5. The method of constructing a bowling lane as recited in claim 1 further comprising the steps of constructing said approach panel from wood, and constructing said lane panel from a synthetic material.

6. The method of constructing a bowling lane as recited in claim 1 further comprising the step of forming a step-up junction where the top surface of the lane panel is at a level below the top surface of the foul line coupling when the step of the lane panel is inserted into the open portion of the J-shaped coupling.

7. The method of constructing a bowling lane as recited in claim 6 is further comprising the step of attaching a layer of elongated clear plastic film with adhesive disposed on one side of said film and over said lane panel; and depositing a lane finish over the other side of said film so that the top surface of said lane finish is substantially coplanar with the top surface of the J-shaped coupling.

8. The method of constructing a bowling lane as recited in claim 21 further comprising the step of terminating the clear plastic film at an edge of said lane panel and out of contact from said J-shaped coupling.

9. A bowling lane comprising:

an approach panel having a flat top surface and a step formed into said panel along a first of said panel's sides;

a coupling having a bottom portion, a riser portion and a top portion, said bottom portion resting on said step formed into said side panel, said riser portion in cross section extending along said panel first side at an angle substantially perpendicular to the bottom portion and a top portion extending away from said riser and said panel parallel to said bottom portion; and a lane panel having a flat top surface and a step formed into said lane panel along one of said lane panel sides, said lane panel step being coupled to said coupling to form a contiguous bowling panel with the approach panel step, said riser portion and said lane panel step.

10. The bowling lane as recited in claim 9 wherein said approach panel is constructed of wood, and wherein said lane panel is constructed of a synthetic material.

11. The bowling lane as recited in claim 10 wherein said synthetic material is phenolic.

12. The bowling lane as recited in claim 9 further comprising means for removably attaching said coupling bottom portion to said step formed into said side panel.

13. The bowling lane recited in claim 12 wherein the removably attaching means comprises threaded fasteners.

* * * * *